US005337443A

United States Patent [19]

Steinberg et al.

[11] Patent Number: 5,337,443

[45] Date of Patent: Aug. 16, 1994

[54] VACUUM CLEANER

[75] Inventors: Gary L. Steinberg, Jenison; Giovanni Pino, Grand Rapids; Kenneth E. Gibbs, Wyoming; Richard L. Norwood, Rockford; Gary L. Smith, Belding, all of Mich.

[73] Assignee: Bissell Inc., Grand Rapids, Mich.

[21] Appl. No.: 917,820

[22] Filed: Jul. 21, 1992

[51] Int. Cl.[5] ..... A47L 5/24

[52] U.S. Cl. ..... 15/344; 15/350; 15/352

[58] Field of Search ..... 15/344, 347, 350, 352

[56] References Cited

U.S. PATENT DOCUMENTS

| | | | |
|---|---|---|---|
| D. 144,627 | 5/1946 | Morgan et al. | D9/2 |
| D. 144,628 | 5/1946 | Morgan et al. | D9/2 |
| D. 227,648 | 7/1973 | Yonkers | D7/170 |
| D. 277,516 | 2/1985 | Hayden et al. | D32/18 |
| D. 280,033 | 8/1985 | Miyamoto et al. | D32/22 |
| D. 288,971 | 3/1987 | Hobulin et al. | D32/18 |
| D. 290,894 | 7/1987 | Miyamoto et al. | D32/22 |
| D. 298,875 | 12/1988 | Nakamura | D32/18 |
| D. 314,650 | 2/1991 | Pudwill | D32/18 |
| D. 318,152 | 7/1991 | Pudwill | D32/18 |
| 3,667,084 | 6/1972 | Valbona et al. | 15/323 |
| 3,758,914 | 9/1973 | Nupp et al. | 15/344 |
| 4,380,845 | 4/1983 | Miller et al. | 15/344 |
| 4,542,557 | 9/1985 | Levine | 15/344 |
| 4,573,237 | 3/1986 | Kochte et al. | 15/344 |
| 4,610,048 | 9/1986 | Ishihara et al. | 15/344 |
| 4,644,605 | 2/1987 | Joss et al. | 15/344 |
| 4,665,582 | 5/1987 | Richmond et al. | 15/352 |
| 4,715,084 | 12/1987 | Jacob et al. | 15/328 |
| 4,766,638 | 8/1988 | McDowell | 15/329 |
| 4,841,594 | 6/1989 | Elson et al. | 15/344 |
| 4,930,178 | 6/1990 | Monson et al. | 15/344 |
| 4,942,641 | 7/1990 | Gerke, Jr. et al. | 15/338 |
| 4,993,108 | 2/1991 | Genge et al. | 15/383 |
| 5,046,218 | 9/1991 | Cerri | 15/416 |
| 5,056,186 | 10/1991 | Jiam-Fa | 15/344 |
| 5,107,567 | 4/1992 | Ferrari et al. | 15/344 |

FOREIGN PATENT DOCUMENTS

| | | | |
|---|---|---|---|
| 1147360 | 4/1963 | Fed. Rep. of Germany | 15/344 |

*Primary Examiner*—Timothy F. Simone
*Assistant Examiner*—James F. Hook
*Attorney, Agent, or Firm*—Price, Heneveld, Cooper, DeWitt & Litton

[57] ABSTRACT

A vacuum cleaner convertible between a hand-held vacuum and a stick-type vacuum including a housing having a rondure first end and narrowing to a generally oblate, low profile nozzle at a second end, defining an opening in fluid communication with an interior of the housing. A releasably extensible dirt cup is slidably disposed within the opening in the second end and adapted to move between a retracted position within the housing and an extended position from said housing. The free end of the dirt cup is adapted to detachably retain a floor cleaning tool having a pivoting cleaning head for use on floors or other surfaces to be cleaned. The housing contains means for drawing high velocity air into the elongate dirt cup through the floor cleaning tool and/or free end of the elongate dirt cup so as to entrain dirt and debris and capture it within the dirt cup. The dirt cup is cleaned by withdrawing it from the end of the nozzle and removing the spun-bonded filter assembly before pouring the dirt cup contents into a separate container. The low profile housing, together with the extensible dirt cup and detachable floor cleaning tool, easily adapts to a variety of cleaning needs while simultaneously providing a lightweight and ergonomically balanced cleaning tool.

36 Claims, 6 Drawing Sheets

VACUUM CLEANER

FIELD OF THE INVENTION

This invention relates generally to vacuum cleaners, and particularly to vacuum cleaners convertible from a hand-held vacuum to a stick-type vacuum cleaner.

BACKGROUND OF THE INVENTION

A variety of different dry-type vacuum cleaners are available for a variety of uses ranging from heavy duty rug and carpet cleaners, light duty rug and carpet cleaners for cleaning small spills and crumbs, and compact hand-held cleaners for cleaning cushions, pillows, stair treads and the like. There have also been developed cleaners particularly designed or equipped with conversion tools to be used for special purposes such as removal of spider webs near the ceiling, drapery valences, and other hard to reach areas.

In recent years, due to the introduction of plastics and substantial improvements in the design of electric motors for this type of equipment, the bulk and weight of these machines have been reduced substantially. Also, the development of compact rechargeable, heavy duty batteries has made possible the so-called "cordless vacuum cleaner." However, there remains the problem that the machines are limited to one or two functions. For other functions, it has been necessary to have a second tool or a bulky and clumsy conversion kit. Such tools and conversion kits are necessary because the vacuums are too large or bulky to lift above the head to clean out of reach areas or tight areas.

Stick vacuums, that is hand-held vacuums attached to the end of a rod, were designed to be used to clean carpets or floors from a standing position, or to clean hard to reach areas such as ceilings, drapery valences, and the like. However, a majority of the stick-vacs proved awkward to handle since substantially all of the weight of the vacuum was disposed at the far end of the wand. When used above or off the floor, the mass of the vacuum at the end of the wand requires the operator to exert a great deal of energy in suspending the vacuum at the end of the wand.

SUMMARY OF THE INVENTION

The instant invention provides a vacuum cleaner convertible from a lightweight and maneuverable hand-held vacuum to an extended stick-like vacuum to clean floors from a standing position and otherwise inaccessible areas. In the extended position, the nozzle is sufficiently strong to support the weight of the vacuum. Moreover, the vacuum cleaner is adapted to receive a floor cleaning tool or head which may be used in either the extended or retracted position, depending upon the desired cleaning task to be performed.

The vacuum cleaner includes a low profile, oblate housing having an opening in a first end which extends substantially the length of the housing, and having a shape substantially identical to the exterior shape of the housing. The housing is enlarged toward the second end to contain a motor driven fan for drawing air into the first end and out the second end of the vacuum housing. Telescopically received within the first end of the housing is an elongate tubular dirt cup adapted to slide therein between a first retracted position and a second extended position. The tubular dirt cup may be locked into any one of a number of positions between and including the fully retracted and extended positions. The dirt cup includes a removable filter at one end and a flapper valve at an opposite end adapted to prevent the debris from falling back out the dirt cup once captured. A handle extending from the top of the vacuum cleaner housing provides a compound grip to optimally position the center of gravity of the vacuum when used as a hand-held vacuum or in the extended position as a stick-like vacuum. The angles of the two grip positions are ergonomically designed so the operator may comfortably use the vacuum.

The instant invention provides numerous advantages over prior hand-held and stick-like vacuum cleaners, including the ergonomic design for the wide range of readily convertible operating positions, as well as the low profile nozzle to access tight or otherwise inaccessible areas. The extensible dirt cup offers the advantage of a stick vacuum without the stick, and always provides the same travel distance for debris entering the vacuum before it is captured by the filter regardless of whether in the retracted or extended position, making for a more efficient vacuum. Moreover, the short distance to the dirt cup reduces the risk that debris may clog or block the intake. The improved filter design also improves operational and cleaning functions. The combination of the dirt cup/extension into the extensible dirt cup reduces the need for parts in assembly as well as reduce replacement part inventory, while also providing an attractive, versatile and easily maneuverable design. The low profile and linear alignment of the components may be formed from inexpensive materials and easily assembled, thus providing an inexpensive yet efficient and versatile vacuum cleaner.

BRIEF DESCRIPTION OF THE DRAWINGS

A better understanding of the objects, benefits and advantages of our invention may be obtained from the appended detailed description and drawings, wherein.

DETAILED DESCRIPTION OF THE THE PREFERRED EMBODIMENTS

Figure 1:
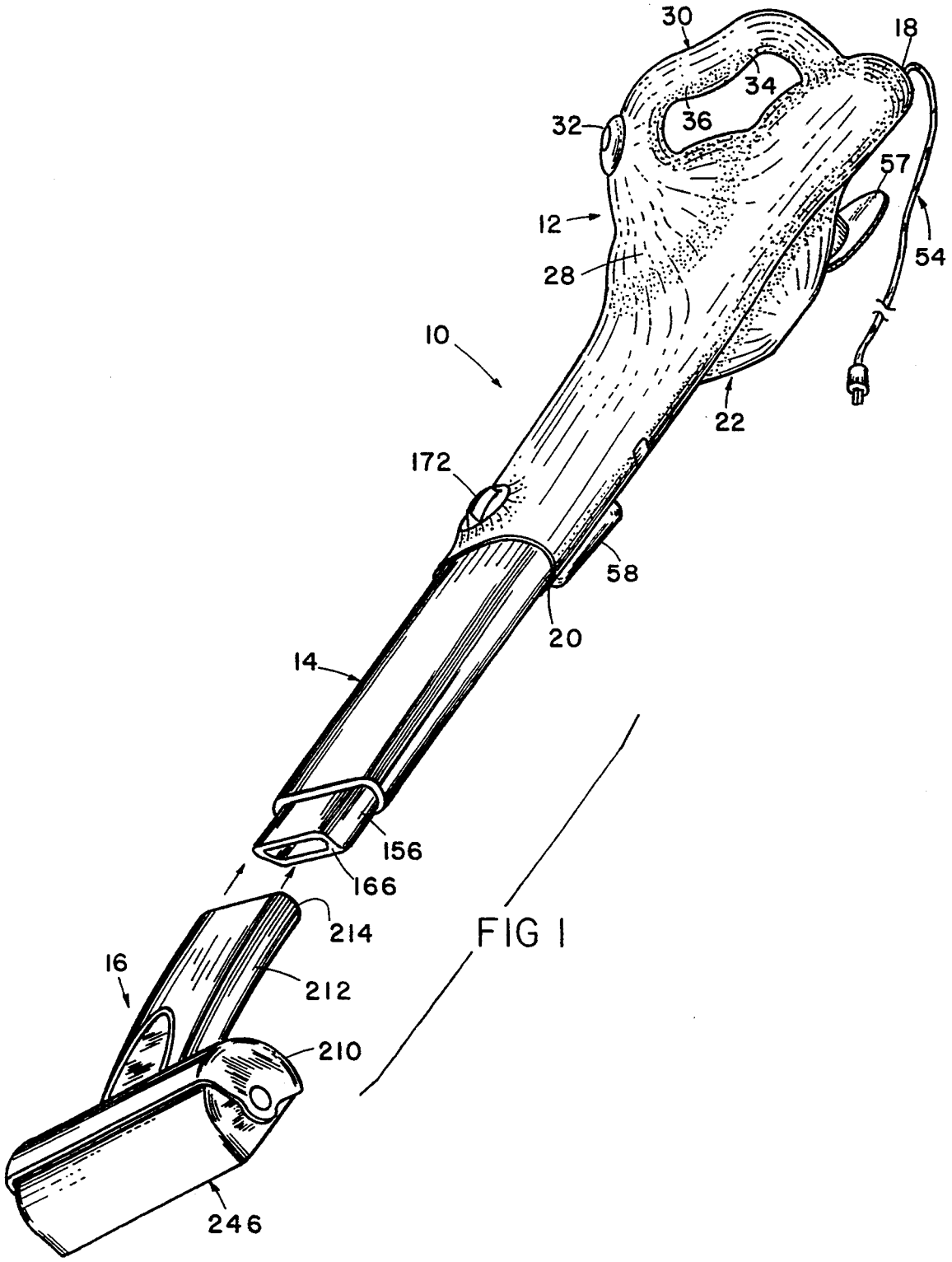
FIG. 1 is an oblique view of one embodiment of the invention.
Figure 2:
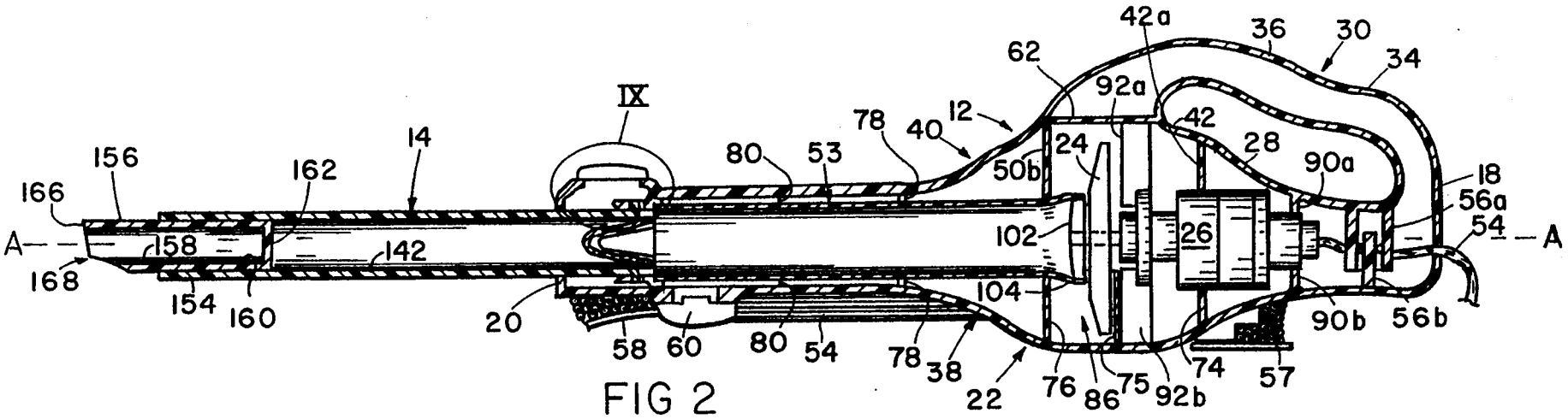
FIG. 2 is a side, cross-sectional view taken along lines II—II in FIG. 1.

Throughout the following description referring to the many drawing figures, like reference numerals will be used to indicate like components, wherein FIG. 1 illustrates one embodiment of a vacuum cleaner 10 of this invention including an elongate, low profile, oblate housing 12, a variably extensible dirt cup 14 and a detachable floor cleaning tool 16. Housing 12 has a first and second end 18 and 20, respectively defining a longitudinal axis A—A extending therebetween. Proximate first end 18 and located approximately one-quarter of the length of housing 12 is an enlarged, rondure, or bulbous portion 22 adapted to accommodate a centrifugal fan 24 (FIGS. 2 and 3) and an air-cooled electric motor 26 therein. From rondure or enlarged portion 22 to second end 20, the size of housing 12 is reduced forming a low profile, elongate nose portion 23 having a substantially oblate or elliptical cross section perpendicular to longitudinal axis A—A of housing 12. The low profile, oblate portion or nose 23 and dirt cup 14 provides sufficient cross-sectional area for good air flow while simultaneously allowing access of dirt cup 14 and nose portion 23 to otherwise inaccessible areas.

Integral with housing 12 and extending from an upper surface 28 of rondure portion 22 is a handle 30 rejoining housing 12 near first end 18. Handle 30 includes a switch 32 for turning the motor 26 on and off, and a compound angle forming two ergonomically designed grip positions or portions 34 and 36. The angular orientations of the two grip positions 34, 36 are adapted to position the vacuum's center of gravity either below or ahead of the user's hand while the vacuum is used as a hand-held vacuum or as stick-like vacuum. For example, grip position 34 may be inclined between 5 degrees and 15 degrees from longitudinal axis A—A to provide a grip position suitable for use as a stick vacuum. Grip position 36 may be inclined between 10 degrees and 25 degrees with respect to longitudinal axis A—A to provide an ergonomic grip when used as a hand-held vacuum.

Figure 7:
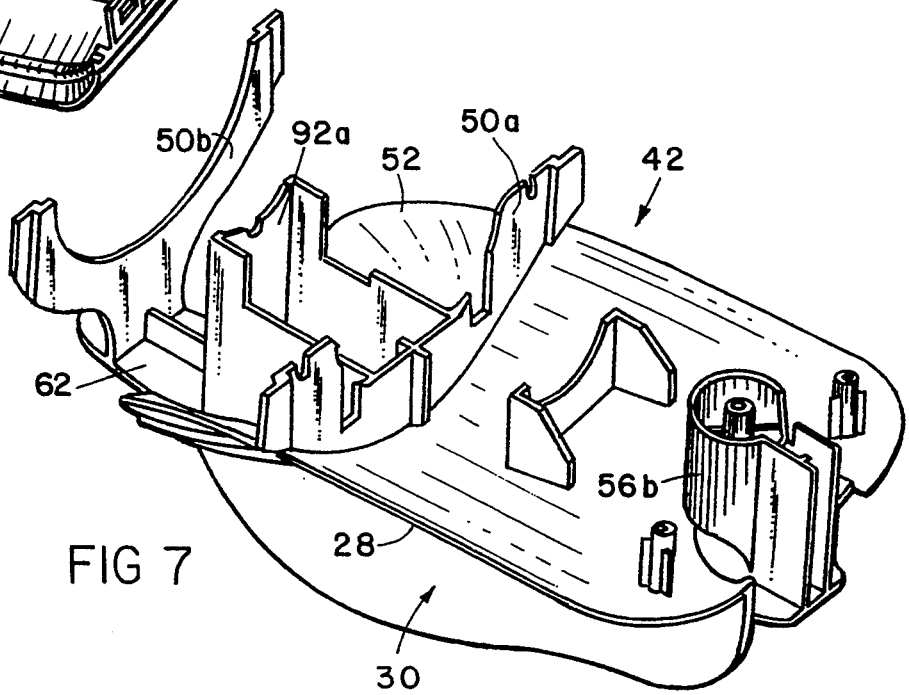
FIGS. 6 and 7 are oblique views of an insert for the upper one-half of the housing.
Figure 6:
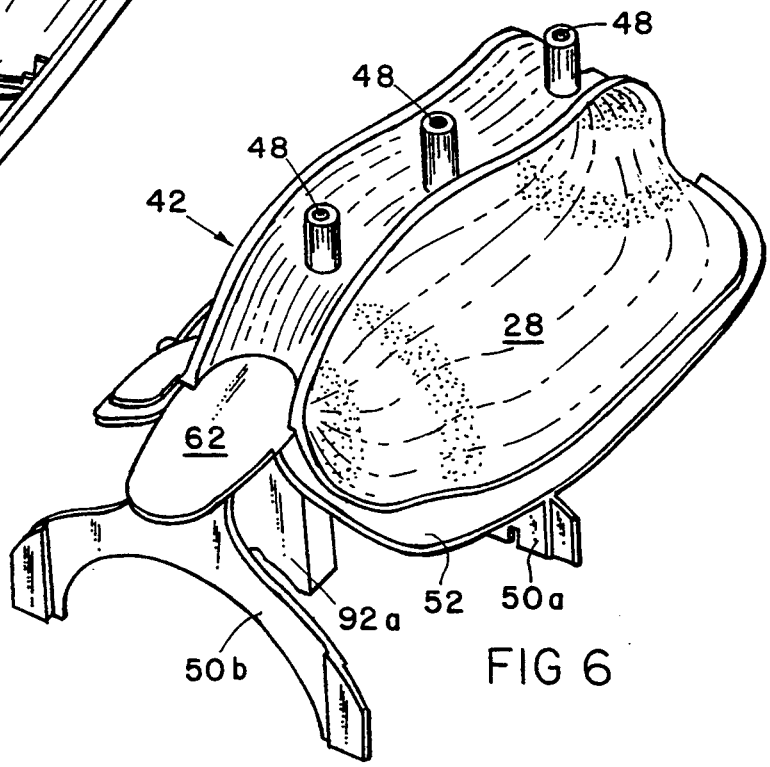
Figure 8A:
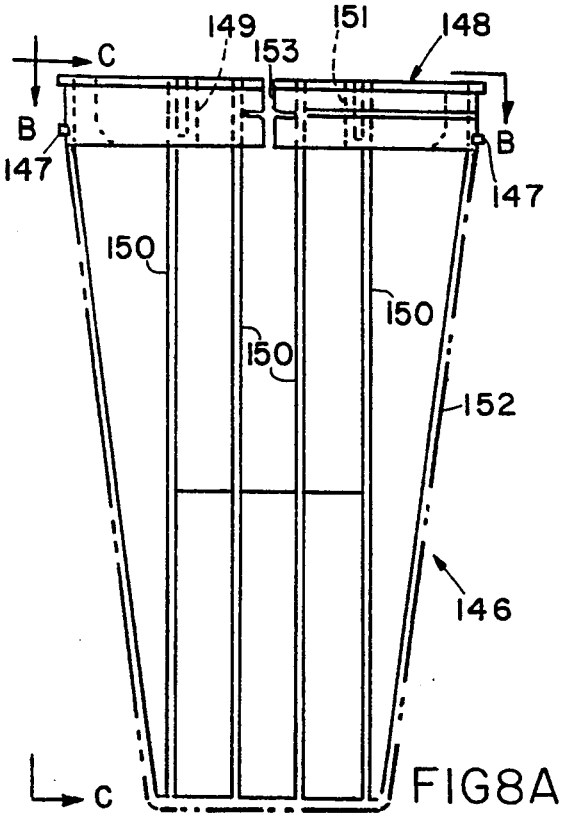
FIGS. 8A–8D illustrate one embodiment of a filter assembly for use in this invention.
Figure 8D:
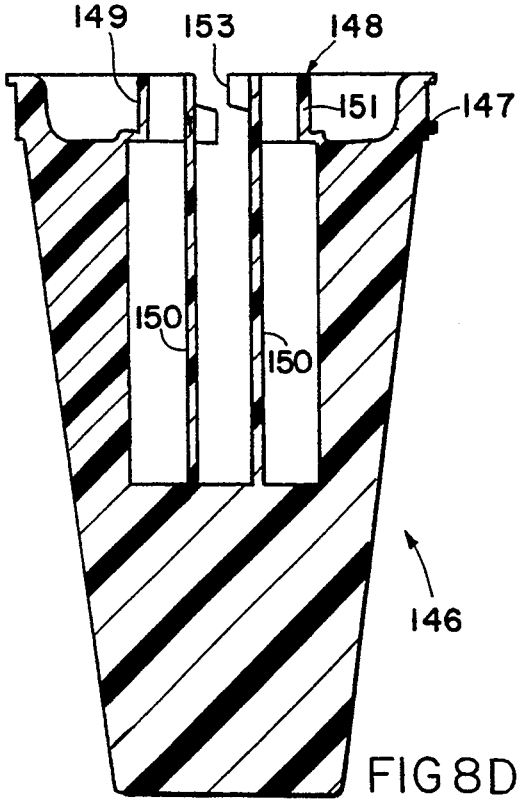
Figure 8C:
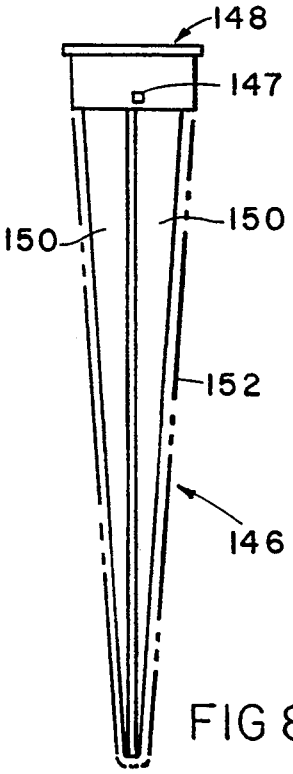
Figure 8B:
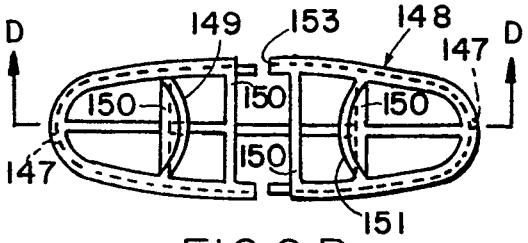

Housing 12 is preferably formed from a high impact polystyrene plastic (HIPP) in three separate pieces: one forming lower half 38 and two parts, upper housing 40 and handle insert 42, forming the other half. Handle insert 42 is adapted to fit within opening 44 of upper housing 40 to complete the lower side of handle 30 and the upper surface of bulbous portion 22 for the fan and motor 24, 26 (FIGS. 6 and 7). Handle insert 42 and upper housing 40 may be held together by post and socket fasteners 46, 48, respectively, extending from the respective portions comprising handle 30. Ribs 50 extending from lower surface 52 of handle insert 42 extend laterally beyond the portion comprising outer surface 28 of rondure housing 22, thus preventing it from extending beyond the remainder of outer surface 28 of housing 40. Each piece is preferably formed using well-known injection molding techniques.

An electric cord 54 exiting first end 18 of housing 12 is used to supply AC current to motor 24. A first end of cord 54 is secured within housing 12 by anchor **56*a*–56*b* (FIGS. 4 and 7) such that any tensional force applied to cord 54 will not break the electrical coupling to motor 24. Because of the compact nature of housing 12, it is preferred that cord 54 be stowed on the exterior of housing 12**.

First end 18 of lower housing 38 is adapted to receive a plate 57 (FIGS. 1 and 2) at the base of rondure portion 22, disposed parallel to the longitudinal axis A—A of housing 12. Cord 54 is also wrapped about a hook 58 extending from a disc 60 rotatably coupled with lower housing 38 proximate second end 20. Disc 60 includes a shaft 62 journaled within a hole in lower housing 38 adapting disc 60 to rotate about the shaft. Cord 54 may be wrapped around plate 56 and hook 58 and retained in place using a conventional catch (not shown) formed in the plug and adapted to pinch an adjacent portion of the cord. Cord 54 may be quickly released by rotating disc 60 such that hook 58 is positioned toward the rear of housing 12 and allowing cord 54 to fall free.

Although this invention has been described with an electric cord stowed on the exterior of the vacuum housing, it is contemplated that first end 18 of housing 12 may be slightly modified to accommodate a cord reel well-known in the art. It is further contemplated by the invention that AC power may be substituted by a DC power supply consisting of rechargeable batteries. Such a DC power supply may be easily accommodated within housing 12 as well as the appropriate circuitry used to recharge the cells. Each of the above modifications may be made using conventional and readily available materials.

The interior surfaces 70 and 72 (FIGS. 4 and 5) of upper and lower housings 38 and 40, respectively, generally conform to the external shape, periodically reinforced and strengthened by ribs or bulkheads 74–84 (FIGS. 2–5). Each rib extends substantially perpendicular to the longitudinal axis of housing 12. Ribs **50*a* and 50*b*, together with tongue 62 extending from insert 42, cooperate with ribs 74, 76 extending from lower housing 38 to form a chamber 86 enclosing fan 24. Motor 26 is supported within housing 12 by ribs and/or mounts such as 50*a*, 74, 90*a*–90*b* and 92*a*–92*b* so that fan 24 is unencumbered and free to rotate within chamber 86**.

Centrifugal fan 24 located within chamber 86 is oriented to draw air in through extensible dirt cup 14 and out through perforations 100 in first end 18 of lower housing 38. Fan 24 is preferably powered by an electric motor 26, such as made by Ametek's, Lamb Electric Division of Ohio. Motor and fan 24, 26 are supported within chamber 86 such that an air inlet 102 of fan impeller 24 is concentrically received within one end 104 of casing 53. Casing 53 extends from first end 104 immediately adjacent impeller 24, terminating at its second end 106 just inside second end 20 of housing 12.

Figure 4:
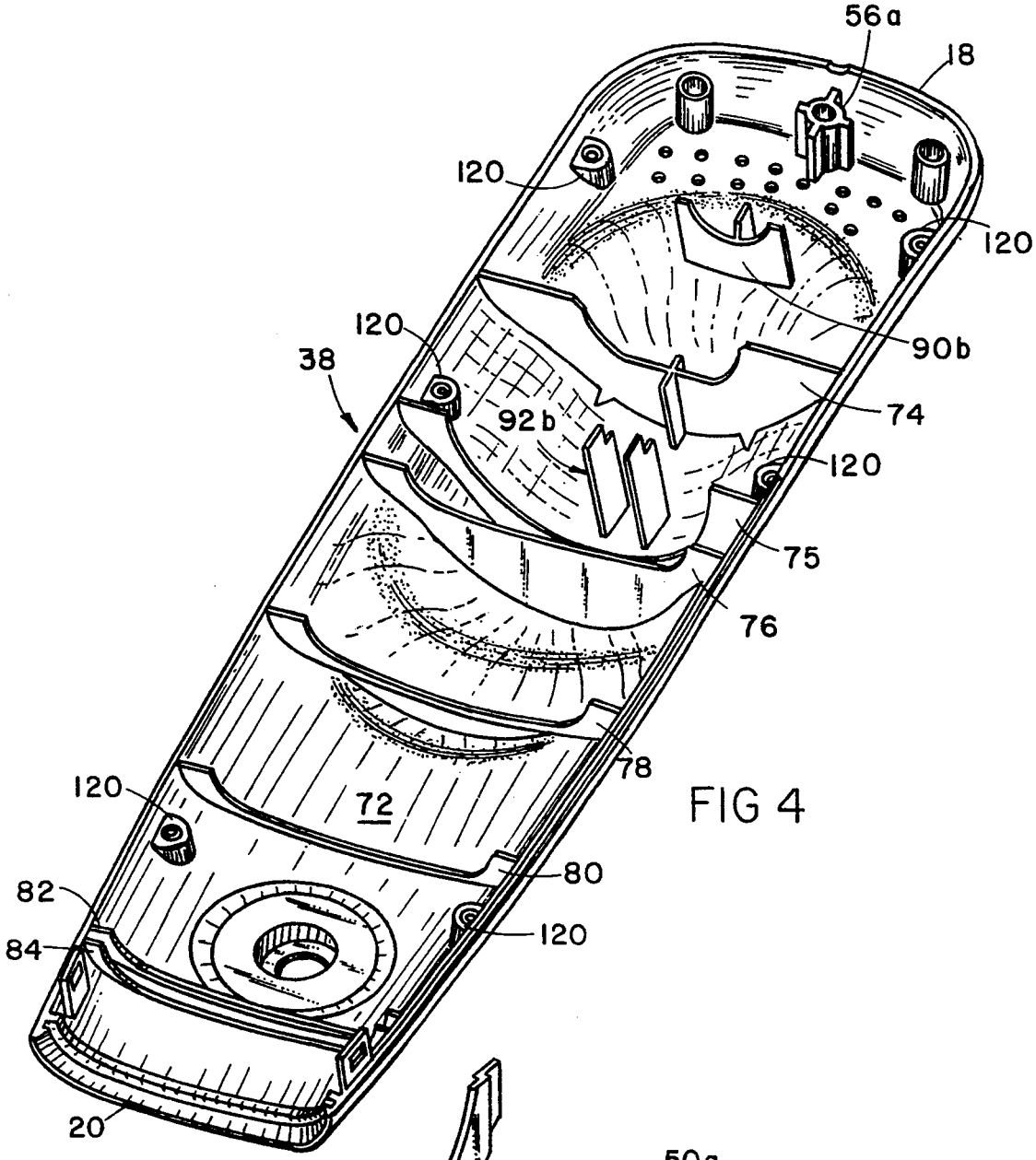
FIG. 4 is an oblique view of the lower one-half of the housing.
Figure 5:
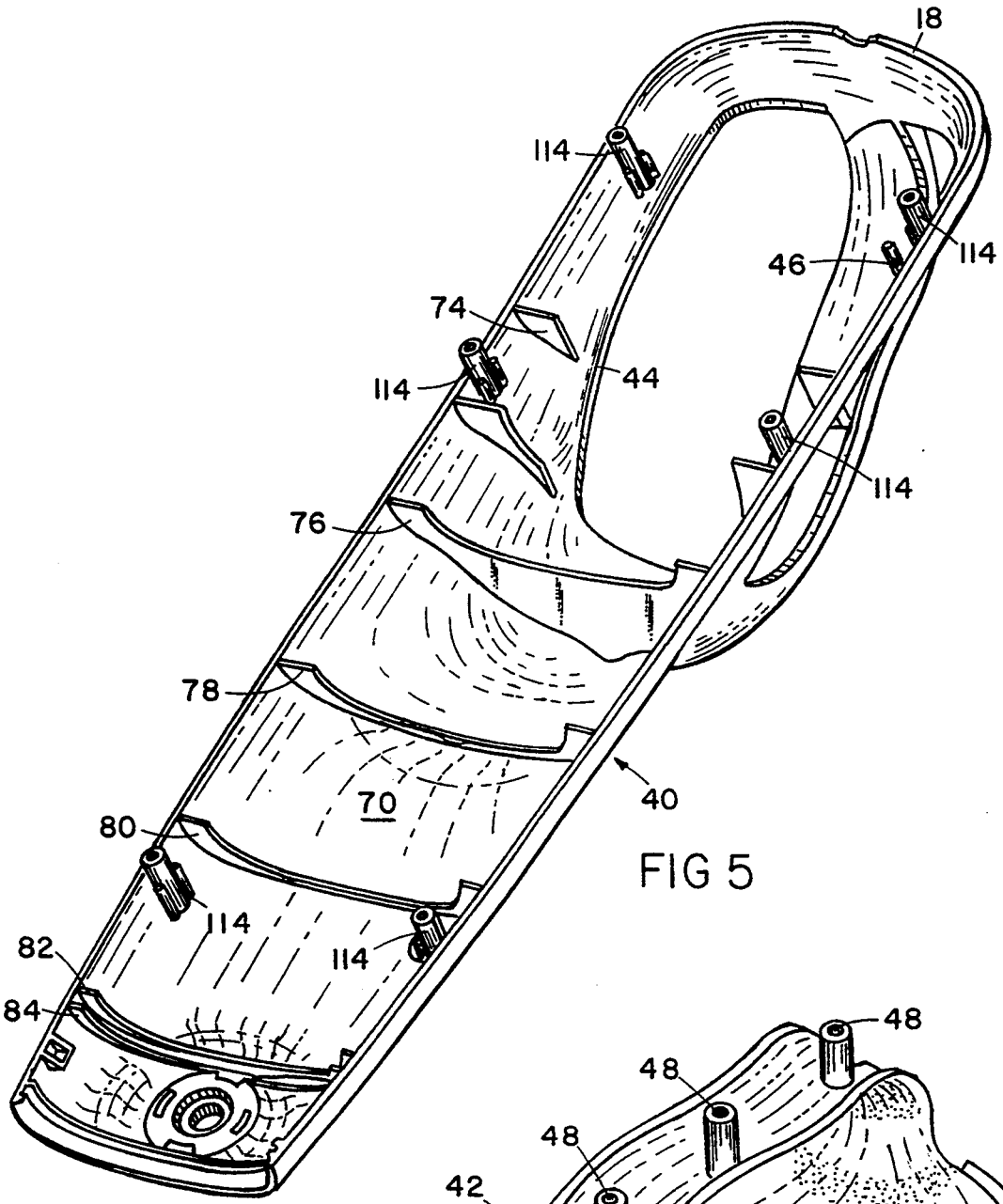
FIG. 5 is an oblique view of the upper one-half of the housing.

Casing 53 is centered within housing 12 and retained therein by ribs 76–84 defined in each half 38, 40 of housing 12. Ribs 82 and 84 (FIG. 9) are specifically adapted to engage grooves 108 extending around outer surface 110 of casing 53 near second end 112. Ribs 76–84 and upper and lower housing 38 and 40 are specially designed to be clamped together about fan 24, motor 26 and casing 53 in registered alignment by bosses 114 receiving threaded fasteners extending through sockets 120 in lower housing 38 (FIGS. 4 and 5).

Figure 3:
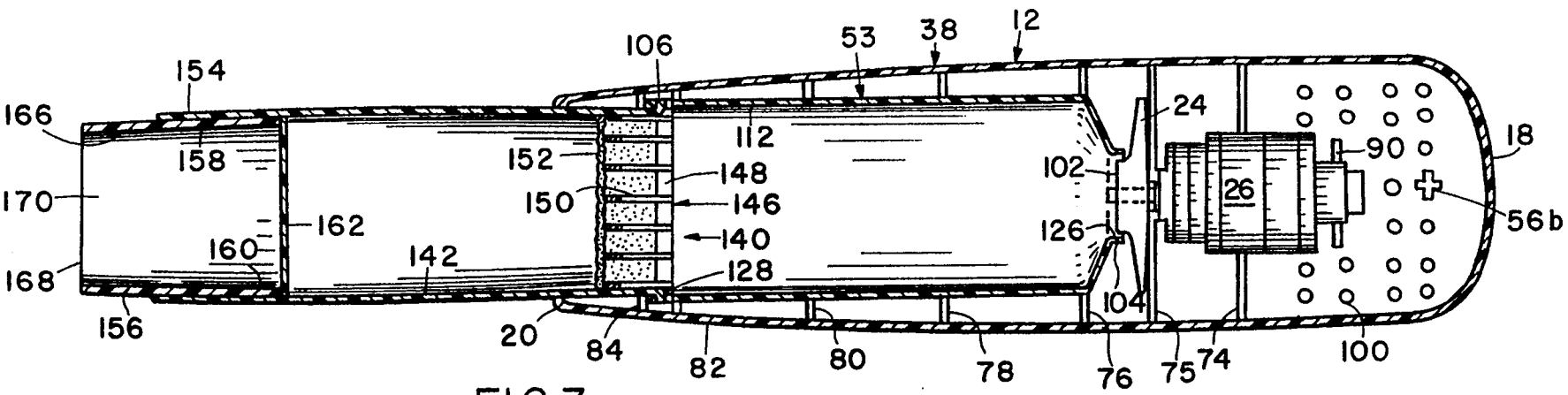
FIG. 3 is a cross-sectional view taken along lines III—III in FIG. 2.

The geometry of casing 53 changes from end-to-end (FIG. 3). At end 104, opening 126 is generally circular, having an inside diameter slightly larger than the outside diameter of air inlet 102 of impeller 24. It is preferred that substantially close tolerances be maintained between the outside diameter of impeller air inlet 102 and the inside diameter of opening 126 to assure efficient air flow. Casing 53 tapers rapidly outward from end 104 in a horizontal direction to obtain a maximum cross-sectional area within the oblate shape of housing 12 toward second end 20. Slidably received in second end 106 is the extensible dirt cup 14 adapted to extend from and retract within the casing. Second end 106 has an opening 128 shaped substantially identical to the outer surface 130 of dirt cup 14 with at least a portion of end 106 (FIG. 9) having a concentric channel or groove 132 bounded by ramping surfaces 134, 136, each adapted to glide up and over dirt cup end 140. The portion of end 106 containing latch 132 may be separated from adjacent portions of casing end 106 by slots (not shown) to allow that portion of the casing to expand and flex up and over onto dirt cup end 140.

The inner surface 112 of casing opening 128 fits closely with outer surface 130 of dirt cup 14 to provide a substantially airtight seal. However, if desired, a gasket or sealing material (not shown) may be fixed along either ramp surface 134 or 136, or along any other portion of casing 53 or housing 12 in contact with outer surface 130 of dirt cup 14 to form the seal. The gasket or seal may also act as a bearing surface to reduce the friction associated with the sliding motion of dirt cup 14 within casing 53. Both casing 53 and dirt cup 14 may be formed from a polymeric material using well-known molding techniques to produce the inner passages and openings.

Dirt cup 14 has a tubular inner wall 142 forming a passage extending the length of the dirt cup and concentric with the longitudinal axis A—A of vacuum 10. A first end 140 of dirt cup passage 142 is adapted to receive a filter assembly 146 (FIGS. 8A–8D) including a split-oval frame 148 having a plurality of tapered ribs 150 extending perpendicular therefrom. Frame 148 is fitted with a spun-bonded polypropylene filter 152 which may be pleated or sewn together to form a pocket for each rib 150, effectively increasing the surface area of filter 152 to trap dirt and debris. Filter assembly 146 is disposed within passage 142 such that the ribs 150 are oriented toward second end 154 of dirt cup 14. Filter assembly 146 may be retained within first end 140 by locking tabs 147 extending from each apex of the generally elliptical frame adapted to engage complimentary slots or notches formed on the inside of dirt cup first end 140. Filter assembly 146 may be disengaged from first end 140 by pinching ribs 149 and 151 together, closing gap 153 and withdrawing locking tabs 147 from dirt cup end 140.

Second end 154 of dirt cup 14 is fitted with an insert 156 having an external shape substantially similar to the oblate or elliptical transverse section exhibited by dirt cup 14 and second end 20 of housing 12. However, with respect to insert 156, the external dimensions preferably do not exceed the internal dimensions of passage 142 in order to be telescopically received by floor cleaning tool 16 described in greater detail below. Insert 156 includes a passage 158 extending therethrough parallel to and preferably concentric with longitudinal axis A—A of vacuum 10. End 160 disposed within passage 142 is adapted to retain a flapper valve 164 adapted to seat passage 158 with flow in a single direction. The nozzle or second end 166 of insert 156 includes an end face 168 and contains opening or orifice 170 to passage 158. Nozzle end face 168 is angled between 35 degrees and 55 degrees with respect to longitudinal axis A—A, generally placing it parallel to the surface to be cleaned with the operator holding either one of the two grip positions 34, 36 on handle 30.

Figure 9:
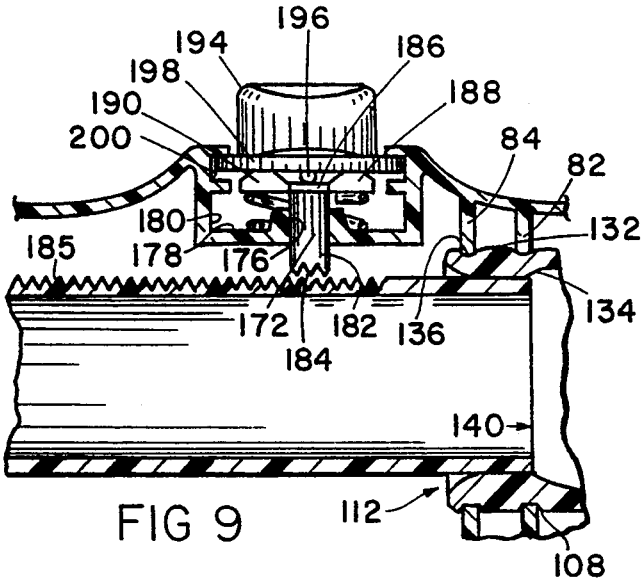
FIG. 9 is an enlarged, fragmentary side cross-sectional view of one embodiment of a locking mechanism.

Dirt cup 14 is adapted to slidably extend from and retract within casing 53. To maintain any one position, a locking mechanism 172, as shown in FIG. 9, extends through housing 12 proximate second end 20 and includes a plunger 174 extending through a hole 176 defined in the bottom 178 of a cylindrical recess or cavity 180 formed within housing 12. Tip 182 of plunger 174 includes serrations 184 adapted to engage serrated grooves 185 formed along the outer surface 130 of dirt cup 14. An opposite end 186 of plunger 174 has a flange or plate 188 containing a cam 190 along an upper surface. Disposed above flange 188 and cam surface 190 is a knob 194 having a lower cam surface 196 adapted to engage cam 190. Knob 194 also includes a flange 198 extending around its perimeter adapted to engage a retaining channel 200 which holds knob 194 against cam surface 190 of plunger 174. Rotation of knob 194 engages cam surfaces 190 and 196, forcing plunger 174 downwardly against spring 208 and forcing tip 182 against serrated grooves 185 in dirt cup outer surface 130. Friction between tip 182 and serrated grooves 185 in outer surface 130 is sufficiently strong to retain dirt cup 14 in position while vacuum 10 is in use. Rotating knob 194 in an opposite direction disengages cam surfaces 190 and 196 and allows spring 208 to bias plunger 174 upwardly to disengage tip 182 from dirt cup 14.

Figure 10:
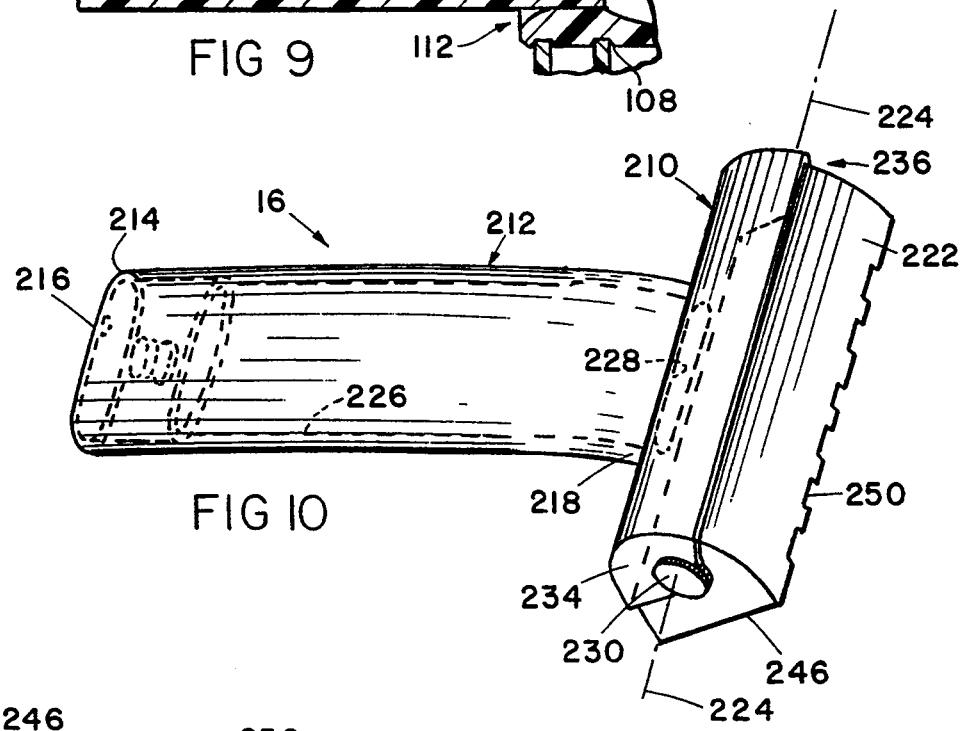
FIGS. 10 and 11 generally illustrate one embodiment of a floor cleaning tool.

In one embodiment, vacuum 10 includes a detachable floor cleaning tool 16 (FIGS. 1 and 10) having a foot 210 disposed at one end of an elongate neck 212. The exterior of neck 212 is substantially identical in shape to the exterior shape of dirt cup 14. At an upper end 214, neck 212 has a cavity 216 adapted to firmly receive nozzle 166 of insert 156 and retain tool 16 thereon. The opposite end 218 of neck 212 is connected to foot 210 comprising a shroud 220 about a floor engaging head 222 pivotal about an axis 224. A passage 226 within neck 212 extends the entire length thereof from the bottom of cavity 216 to an opening 228 within shroud 220. Tool 16 may be formed from the same material as casing 53 using the same molding technique.

Figure 11:
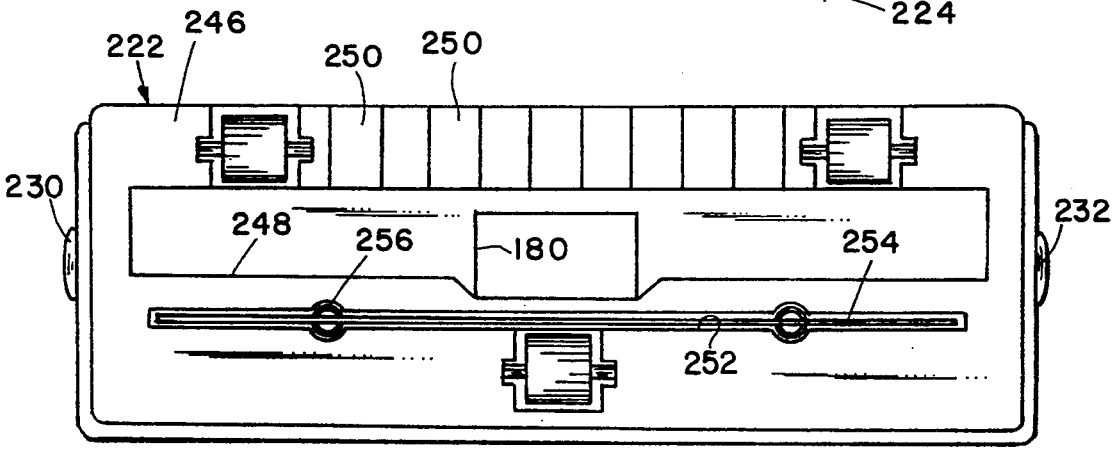

Floor engaging head 222 within shroud 220 is substantially a cylinder having outside dimensions substantially identical to the inside dimensions of shroud 220 and is pivotally coupled at its ends 230 and 232 to shroud ends 234 and 236 (FIG. 11). Head 222 is preferably formed as two pieces adapted to snap-fit together. Each half of head 222 may be made from injection molded ABS or high impact, high heat polystyrene plastic. Head 222 has a flat 246 parallel to axis 224 and adapted to engage the floor (FIG. 11). At least one channel 248 is formed therein, extending along the length and increasing in depth from its outer ends 230 and 232 toward a centerline. Channel 248 converges to a throat 180 extending perpendicular to axis 224 and in fluid communication with passage 226 extending from shroud 220. Additional channels 250 may be formed within flat 246 extending from the external surface of head 222 and connected to channel 248. Channels 250 within floor engaging head 222 are designed to provide a means for causing a high velocity stream of air to pass through or close to the surface to be cleaned to entrain dirt and other materials on or in that surface. In addition, flat 246 includes a recess 252 adjacent and parallel to the rear edge of channel 248 adapted to retain a flexible and resilient strip brush 254. Brush 254 is biased outwardly in a direction perpendicular to flat 246 by springs 256 disposed between the head interior and strip brush 254. To facilitate easy movement of head 222 along the surface to be cleaned, flat 246 includes a plurality of wheels 258, proportionally spaced about in flat 246.

In operation, the desired configuration is selected by the operator to suit the cleaning task to be performed. For example, if vacuum 10 is desired to be used in a hand vacuum configuration, knob 194 is rotated to release dirt cup 14 such that it may be retracted a predetermined distance within housing 12. If a small area is to be cleaned, foot 16 may be removed from the end of dirt cup 14 by simply pulling on the pressure connection. With dirt cup 14 in a retracted position within housing 12, the operator holds vacuum 10 by grasping grip position 34 of handle 30 locating the center of gravity below the operator's hand and slightly forward, such that end face 168 of dirt cup 14 may be naturally placed substantially parallel to the surface to be cleaned. With the operator gripping position 34, the vacuum may be easily actuated by depressing switch 32.

For areas out of reach of the user, dirt cup 14 may be extended by rotating knob 194 to disengage dirt cup 14. The dirt cup may then be extended to the desired length and locked into position by rotating knob 194. The operator may then actuate vacuum 10 and perform the cleaning task.

For cleaning large surface areas such as a floor, the operator moves dirt cup 14 to its fullest extension and locks it in place. The operator may also attach cleaning foot 16. Foot 16 is retained on the end of dirt cup 14 by a friction coupling between cavity 216 and insert 156. The operator may stand upright, grasping vacuum 10 at grip position 36, thus locating the center of gravity substantially below and forward of the grip position to aid in moving the vacuum along the surface to be cleaned. Because the dirt cup extends, a substantial portion of the vacuum weight is retained near the compound handle, making for easy manipulation of the vacuum. Because the dirt cup extends instead of moving the vacuum body further from the user, this invention provides all the advantages of a stick-like vacuum, but without the stick and associated weight shift.

To evacuate dirt and debris contained in vacuum 10, foot 210 may be removed and dirt cup 14 completely withdrawn from housing 12. Dirt cup 14 is released from housing 12 by disengaging plunger 174 and pulling dirt cup 14 from end 112 of casing 53. With dirt cup 14 removed, filter assembly 146 may be withdrawn from first end 144 by pinching ribs 149, 151. Spun-bonded, polypropylene filter 152 may be removed from frame 148 and washed or otherwise cleaned to remove dirt and debris. Filter 152 may be replaced on frame 148 such that ribs 150 extend into filter 152. With filter assembly 146 withdrawn from dirt cup 14, dirt and debris not entrained in filter 152 may be emptied into another container. Filter assembly 146 is then reinserted into first end 144 such that locking tabs 147 engage recesses in the first end 140 of dirt cup 142 and dirt cup 14 is then reinserted into housing 12. Operation resumes as outlined above.

Although the invention has been described with respect to specific preferred embodiments thereof, many variations and modifications will become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows.

1. A vacuum cleaner, comprising:

a housing having a first and second ends;

a tubular dirt cup slidably disposed within said first end of said housing and adapted to move telescopically between a first position within said housing and a second position extending from said housing; and a fan assembly disposed within said housing for creating a vacuum in said tubular dirt cup.

2. The vacuum cleaner of claim 1, further including:

means for fixing the position of said tubular dirt cup between and including said first and last positions; and means within said tubular dirt cup for trapping dirt and debris therein.

3. The vacuum cleaner of claim 2, wherein said housing includes a handle extending from an upper portion of said enlarged portion and defining at least two grip positions at different angles with respect to a longitudinal axis of said housing.

4. The vacuum cleaner of claim 3, further including a floor cleaning tool detachably coupled to an end of said tubular dirt cup extending from said nozzle, said floor cleaning tool having a pivotal floor engaging head.

5. The vacuum cleaner of claim 4, further including:

a casing within said housing and having a first end concentric with said suction means and a second end slidably receiving said tubular dirt cup; and means for restraining withdrawal of said tubular dirt cup from said casing.

6. The vacuum cleaner of claim 5, wherein said means for fixing the position of said tubular dirt cup includes:

a biased plunger having a tip adapted to engage said tubular dirt cup;

a knob disposed above said plunger; and cam means between said knob and said plunger for engaging and disengaging said plunger with respect to said tubular dirt cup.

7. The vacuum cleaner of claim 6, wherein said suction means includes:

a centrifugal fan having a central air inlet;

a motor driving said centrifugal fan; and said centrifugal fan having said central air inlet disposed within and concentric within said first end of said casing and enclosed within a chamber within said housing.

8. A vacuum cleaner convertible between a hand-held vacuum to a stick-type vacuum, comprising:

a housing having a rondure portion near a first end and an oblate, low profile portion at a second end defining a longitudinal axis;

an elongate dirt cup slidably disposed within said second end low profile portion and adapted to move telescopically between a first portion within said housing and a second position extending from said housing;

a handle integral with and extending from an upper surface of said rondure portion defining a first and a second grip portions, each disposed at a different angle with respect to said longitudinal axis of said housing; and means disposed within said rondure portion of said housing for creating a vacuum and drawing air in through said elongate dirt cup.

9. The vacuum cleaner as recited in claim 8, further including means extending through a wall of said housing for releasably fixing a position of said elongate dirt cup between, and including, said first and second positions.

10. The vacuum cleaner as recited in claim 8, including a floor cleaning tool detachably coupled to one end of said elongate dirt cup, said floor cleaning tool having a cleaning head pivotally coupled within a shroud disposed perpendicular to said longitudinal axis of said housing.

11. The vacuum as recited in claim 8, further including a casing coaxially disposed within said low profile portion and adapted to slidably receive said elongate dirt cup.

12. The vacuum cleaner as recited in claim 9, wherein said fixing means includes:

a plunger having an axis substantially perpendicular to the longitudinal axis of said housing and a tip adapted to releasably engage said elongate tubular dirt cup to hold said dirt cup in fixed relation to said housing; and means for releasably urging said plunger against said elongate tubular dirt cup.

13. The vacuum cleaner as recited in claim 10, wherein said cleaning head of said floor cleaning tool includes a flat adapted to engage the surface to be cleaned and having a channel extending substantially perpendicular to the longitudinal axis of said housing, said channel in fluid communication with a leading edge of said cleaning head by at least one passage formed therein to generate a high velocity stream of air to pass through or over the surface to be cleaned to entrain dirt and other debris on or in that surface.

14. The vacuum cleaner as recited in claim 8, wherein said vacuum creating means includes:

a motor;

a centrifugal fan coupled to said motor and having a central air intake coaxial with a shaft from said motor;

a casing having a first end concentrically disposed about said air intake of said centrifugal fan and a second end slidably receiving said elongate dirt cup; and a chamber formed by said housing about said first end of said casing and said centrifugal fan having an outlet through said motor and said first end of said housing.

15. A vacuum cleaner, comprising:

an elongate housing having an enlarged portion near first end and a generally oblate portion integral with and extending from said second end of said housing to define a longitudinal axis, said oblate portion having an opening at its free end in fluid communication with an interior of said housing;

a handle integral with and extending from an upper portion of said housing defining at least two grip orientations with respect to said longitudinal axis of said housing;

an elongate dirt cup concentric with said nozzle and slidably telescopically received within said opening, said dirt cup having a passage extending from an inlet at a first end to an opening at a second end, said dirt cup slidably adapted to move between a first retracted position within said oblate portion of said housing to a second extended position; and a motor driven fan disposed within said rondure portion of said housing and adapted to draw air through said inlet and into said dirt cup.

16. The vacuum cleaner of claim 15, including a floor cleaning tool detachably coupled to said first end of said elongate dirt cup.

17. The vacuum cleaner of claim 16, including means for releasably fixing a position of said elongate dirt cup with respect to said housing.

18. The vacuum cleaner of claim 17, including a casing disposed within said housing and slidably receiving said elongate dirt cup, said casing forming a generally tight seal between said motor driven fan and said elongate dirt cup.

19. A vacuum cleaner, comprising:

a housing having an elongate and oblate first end having an opening defined therein concentrically extending the length of said housing;

fan means disposed within said housing distant from said first end for creating a vacuum therein causing air to flow through said opening in said first end and out a second end of said housing;

an elongate tubular dirt cup concentric with and slidably disposed within said opening in said first end and adapted to move telescopically between a retracted position within said housing to an extended position from said opening in said first end;

means extending through said housing and engaging said dirt cup to adjust the position of said dirt cup within said first end;

flapper means disposed within a first end of said dirt cup for providing a single flow direction through said dirt cup;

means disposed within a second end of said dirt cup for filtering the flow of air through said dirt cup;

a floor engaging tool detachably received over said first end of said dirt cup; and an integral handle extending from an upper surface of said housing, said handle having at least two grip positions defined by an obtuse angle.

20. A vacuum cleaner, comprising:

an elongate, generally low profile housing having a first and second end defining a longitudinal axis and having a generally oblate transverse cross section, at least a portion of said housing between said first and second end enlarged, adapted to accommodate means for creating a vacuum within said housing; and a handle extending from and integral with said enlarged portion and said first end of said housing and defining at least two grip positions disposed along dissimilar angular orientations with respect to said longitudinal axis; and an opening defined in said second end of said housing for telescopically receiving an extensible container generally along the longitudinal axis, said container adapted to receive and retain debris drawn therein by said vacuum creating means.

21. The vacuum cleaner of claim 20, further including:

means for adjustably fixing the extensible position of said container with respect to said second end; and a floor cleaning tool detachably coupled to a free end of said extensible container extending from said second end of said housing.

22. The vacuum cleaner of claim 21, wherein said first grip portion is generally above said enlarged portion of said housing and said second grip portion is generally toward said first end of said housing.

23. The vacuum cleaner of claim 22, wherein said handle is curved defining said first and second grip portions so that a hand gripping said first and second grip portions changes an angle of said hand in relationship to said longitudinal axis and the surface being cleaned.

24. The vacuum cleaner of claim 23, wherein said enlarged portion of said housing includes:

a centrifugal fan having an air inlet adapted to draw air in from said second end of said housing and said container; and means for driving said centrifugal fan to create said vacuum.

25. The vacuum cleaner of claim 24, wherein said container includes:

a tubular, generally oblate dirt cup adapted to retract within and extend from said opening in said second end of said housing and having an opening at a first and second end, said first end disposed within said housing;

filter means releasably fixed in said opening in said first end; and a flapper valve disposed within said opening on said second end, adapted to permit air and debris to flow in a single direction in said tubular dirt cup.

26. The vacuum cleaner of claim 25, further including a casing disposed within said second end of said housing and adapted to slidably receive said tubular dirt cup therein in substantially airtight engagement, said casing also adapted to provide fluid communication between said inlet of said centrifugal fan and said openings of said tubular dirt cup so as to entrain debris within a high velocity air stream and capture said debris within said dirt cup.

27. A vacuum cleaner, comprising:

an elongate, generally low profile housing having a first and a second end, said second end having an opening therein in fluid communication with an interior of said housing;

a compound handle extending from said housing and integral therewith, interconnecting said first end with a point between said first and second end of said housing and defining at least two grip portions along said handle, each having a predetermined angular orientation with respect to the longitudinal axis of said housing;

a telescopically extensible container slidably disposed within said opening in said second end of said housing and adapted to be releasably fixed between and including a first retracted position within said housing and a second extended position from said second end;

a casing concentrically received about one end of said extensible container and disposed within said second end of said housing for receiving said container in sliding engagement therein in a first end; and means partially received within a second end of said casing and disposed within said housing for creating a vacuum in said casing and drawing debris entrained therein into said container.

28. The vacuum cleaner of claim 27, wherein said extensible container includes:

filter means detachably fixed within a first end of said container received within said casing; and valve means disposed within an opposite end of said container for retaining debris within said container.

29. The vacuum cleaner of claim 28, wherein said container is releasably fixed with respect to said housing by cam operated means extending through said housing for releasably engaging an exterior surface of said container.

30. The vacuum cleaner of claim 29, further including a detachable floor cleaning tool received about said opposite end of said container.

31. A vacuum cleaner, comprising:

an elongate, generally low profile housing having a first and second end defining a longitudinal axis and having a generally oblate transverse cross section, at least a portion of said housing between said first and second end enlarged, adapted to accommodate means for creating a vacuum within said housing;

a handle extending from and integral with said enlarged portion and said first end of said housing and defining at least two grip portions disposed along dissimilar angular orientations with respect to said longitudinal axis;

an opening defined in said second end of said housing for receiving a telescopically extensible container generally along the longitudinal axis, said container adapted to receive and retain debris drawn therein by said vacuum creating means;

means for adjustably fixing the extensible position of said container with respect to said second end; and a floor cleaning tool detachably coupled to a free end of said extensible container extending from said second end of said housing.

32. The vacuum cleaner of claim 32, wherein said at least two grip portions provide a first grip portion generally above said enlarged portion of said housing and a second grip portion generally toward said first end of said housing.

33. The vacuum cleaner of claim 32, wherein said handle is curved defining said first and second grip portions so that a hand gripping said first and second grip portions changes an angle of said hand in relationship to said longitudinal axis and the surface being cleaned.

34. The vacuum cleaner of claim 33, wherein said enlarged portion of said housing includes:

a centrifugal fan having an air inlet adapted to draw air in from said second end of said housing and said container; and means for driving said centrifugal fan to create said vacuum.

35. The vacuum cleaner of claim 34, wherein said container includes:

a tubular, generally oblate dirt cup adapted to retract within and extend from said opening in said second end of said housing and having an opening at a first and second end, said first end disposed within said housing;

filter means releasably fixed in said opening in said first end; and a flapper valve disposed within said opening on said second end, adapted to permit air and debris to flow in a single direction in said tubular dirt cup.

36. The vacuum cleaner of claim 37, further including a casing disposed within said second end of said housing and adapted to slidably and telescopically receive said tubular dirt cup therein in substantially airtight engagement, said casing also adapted to provide fluid communication between said inlet of said centrifugal fan and said openings of said tubular dirt cup so as to entrain debris within a high velocity air stream and capture said debris within said dirt cup.

* * * * *

UNITED STATES PATENT AND TRADEMARK OFFICE

CERTIFICATE OF CORRECTION

PATENT NO. : 5,337,443
DATED : August 16, 1994
INVENTOR(S) : Gary L. Steinberg et al.

It is certified that error appears in the above-indentified patent and that said Letters Patent is hereby corrected as shown below:

Col. 8, line 44;

"first portion" should be --first position--.

Col. 12, line 23, claim 32;

"claim 32" should be --claim 31--.

Col. 12, line 53, claim 36;

"claim 37" should be --claim 35--.

Signed and Sealed this

Seventh Day of March, 1995

*Attest:*

Bruce Lehman

BRUCE LEHMAN

*Attesting Officer*

*Commissioner of Patents and Trademarks*